US008681012B2

(12) United States Patent
Murray et al.

(10) Patent No.: US 8,681,012 B2
(45) Date of Patent: Mar. 25, 2014

(54) DETECTORS

(75) Inventors: Mark Patrick Murray, Sutton Coldfield (GB); Mark John Downes, Alcester Warwickshire (GB)

(73) Assignee: Marshell Electrical Contractors Limited, Bromsgrove (GB)

( * ) Notice: Subject to any disclaimer, the term of this patent is extended or adjusted under 35 U.S.C. 154(b) by 153 days.

(21) Appl. No.: 13/318,184

(22) PCT Filed: Apr. 30, 2010

(86) PCT No.: PCT/GB2010/050724

§ 371 (c)(1), (2), (4) Date: Oct. 31, 2011

(87) PCT Pub. No.: WO2010/125401

PCT Pub. Date: Nov. 4, 2010

(65) Prior Publication Data

US 2012/0050030 A1 Mar. 1, 2012

(30) Foreign Application Priority Data

May 1, 2009 (GB) ..... 0907527.6
Oct. 10, 2009 (GB) ..... 0917788.2

(51) Int. Cl.
*G08B 17/10* (2006.01)

(52) U.S. Cl.
USPC ..... 340/629; 340/630; 250/574

(58) Field of Classification Search
USPC ..... 340/629–630; 250/574
See application file for complete search history.

(56) References Cited

U.S. PATENT DOCUMENTS

| | | | | |
|---|---|---|---|---|
| 4,099,178 | A | 7/1978 | Ranney et al. | |
| 4,374,329 | A * | 2/1983 | Schoenfelder et al. | 250/574 |
| 4,488,049 | A | 12/1984 | Marsocci | |
| 5,021,677 | A * | 6/1991 | Igarashi et al. | 250/574 |
| 5,170,150 | A | 12/1992 | Austin et al. | |
| 5,497,009 | A * | 3/1996 | Torikoshi et al. | 250/574 |
| 5,705,988 | A * | 1/1998 | McMaster | 340/628 |
| 6,351,219 | B1 * | 2/2002 | Tanguay et al. | 340/630 |
| 7,167,098 | B2 * | 1/2007 | Siber et al. | 340/628 |

FOREIGN PATENT DOCUMENTS

| | | | |
|---|---|---|---|
| EP | 1271444 | A1 | 1/2003 |
| JP | 2242397 | A | 9/1990 |
| JP | 8044986 | A | 2/1996 |
| JP | 8044987 | A | 2/1996 |
| JP | 2002197558 | A | 7/2002 |
| WO | 00/72282 | A1 | 11/2000 |

* cited by examiner

*Primary Examiner* — Tai T Nguyen
(74) *Attorney, Agent, or Firm* — Bishop Diehl & Lee, Ltd.

(57) ABSTRACT

A detector (101) for detecting smoke from a fire and generating an alarm has a detection chamber (105) in which a light source (111) and a light detector (113) are arranged. In normal use, the light detector (113) only receives light from the light source that has been scattered by the presence of smoke in the chamber (105). When testing the detector (101), the light detector (113) receives light from the light source (111) by presenting a reflecting surface (129*a*) of a rotor member (129) to reflect light from the light source (111) towards the light detector (113). In normal use, the rotor member (129) is positioned so that the reflecting surface (129*a*) no longer reflects light from the light source (111) towards the light detector (113).

18 Claims, 5 Drawing Sheets

DETECTORS

TECHNICAL FIELD OF THE INVENTION

This invention relates to detectors and in particular, but not exclusively, detectors that may be used to detect a hazardous condition such as smoke or elevated temperatures that may be indicative of a fire. More specifically the invention is concerned with installation and testing of such detectors.

BACKGROUND OF THE INVENTION

In use, smoke and heat detectors monitor air quality and generate a warning if a level of smoke or temperature exceeding a pre-determined value is detected that may indicate a hazardous condition such as the presence of a fire. Known detectors are often powered by batteries and it is common for such detectors to provide a warning when the battery needs to be replaced. However, reliable operation of the detector can be impaired or prevented if other components of the detector fail.

It is known to fit smoke and heat detectors with a removable cap that protects sensitive internal components of the detector from damage during storage, transportation and installation. Sometimes, it can be desirable to leave the cap in place when the detector is fitted, for example during construction of a new building or renovation of an existing building. However, reliable operation of the detector can be impaired or even prevented if the cap is not removed on completion of construction or renovation, The present invention has been made from a consideration of the foregoing and seeks to provide a detector in which the aforementioned problems are overcome or at least mitigated.

SUMMARY OF THE INVENTION

According to a first aspect of the invention there is provided a detector arranged to be used in detecting fires, the detector incorporating a test facility, the test facility being operable to test at least some of the detection components on which the detector is based.

This may be advantageous as a detector incorporating a test facility capable of testing the actual detection components may offer a convenient way of testing these components.

More preferably, the first aspect of the invention provides detector having sensor means for detecting smoke or heat such as from a fire and generating a warning when activated in a normal mode of operation, and test means operable to activate the sensor means in the absence of smoke or heat in order to test the detector in a test mode of operation.

One embodiment of the invention concerns an optical smoke detector. Optical smoke detectors are commonly used and widely understood in the field of fire detection and warning. Optical smoke detectors include a light source and a light sensor positioned away from the normal passage of light from the light source. When smoke enters the detector, some of the light from the light source is scattered by the smoke and some of this scattered light impinges on the light sensor, which in turn may cause triggering of an alarm. The light source and light sensor as well as their associated electronics are considered herein to be the detection components of the smoke detector and are referred to as an optical smoke sensing system.

The test facility is operable to test at least the operability of the optical smoke sensing system. This may be advantageous as it may provide a convenient way of safely simulating a fire and so testing the optical sensing system, without having to purchase smoke canisters or the like.

Preferably the test facility will indicate a fail condition if the smoke detector is not operating due to failure of any one or more of the light source, light sensor, any associated alarm system and/or power to any of these. This may be advantageous over standard optical smoke detector test facilities, which return a fail condition in response to failure of power to any associated alarm system only.

The test facility may be arranged such that, when activated, at least part of the light from the light source is incident on the light sensor. In this way the scattering effect of smoke in the detector can be simulated, and an alarm associated with the sensor should sound if the light source, photoelectric detector and alarm are all working properly and are supplied with power. If however the alarm does not sound this would be indicative of a failure of either the optical sensing system, the alarm or power to either.

In some embodiments, the test facility is provided with means that provides a reflective surface when the test facility is activated and a non-reflective surface when the test facility is not activated. This may provide a convenient means of reflecting light from the light source when the test facility is activated and providing a passive non-reflective surface when it is not. This may be suitable where the light source and light sensor are angularly offset so that light from the light source is not normally directly incident on the light sensor.

In one arrangement, the test facility may be provided with a liquid crystal display (LCD) that is non-reflecting a normal mode of operation and reflecting in a test mode of operation. Activation of the test facility changes the LCD surface from non-reflective to reflective, for example by breaking a connection that previously allowed the flow of current through electrodes associated with a liquid crystal layer in the LCD.

In another arrangement, the test facility may be provided with a rotor having a reflecting surface and a non-reflecting surface. The rotor may be configured so that, in a normal mode of operation, the non-reflecting surface is presented to the light source and, in a test mode of operation, the reflecting surface is presented to the light source. The rotor may be rotatable to present either the reflecting or non-reflecting surface to the light source.

It will be understood that the LCD or rotor of the above arrangements may be replaced by any device that can be switched to provide a selected one of a reflecting surface and a non-reflecting surface to allow or prevent light from a light source being incident on a light sensor.

In other embodiments, the test facility is provided with means for blocking a light path between the light source and light sensor when the test facility is not activated and unblocking the light path when the test facility is activated. This may provide an alternative means of controlling light from the light source when the test facility is activated and when it is not. Blocking the light path does not prevent light that has been scattered due to the presence of smoke reaching the light source. This may be suitable where the light source and light sensor are aligned so that light from the light source is directly incident on the light sensor in the absence of the blocking means.

In one arrangement, the test facility may be provided with an LCD that allows transmission of light in a test mode of operation and prevents transmission of light in a normal mode of operation. The LCD may be switched between the transmitting and non-transmitting conditions by any suitable means.

In another arrangement, the test facility may be provided with a barrier that is movable between a position that allows light from the light source to reach the light sensor in a test mode of operation and a position that prevents light from the light source reaching the light sensor in a normal mode of operation In some embodiments the test facility is manually actuated via an actuator provided on or in the smoke detector. This may provide a relatively cheap and convenient system for small scale use. Alternatively however the test facility may be activated from a remote location. This may particularly be the case where several detectors are connected to a central detection and/or control system. In this case results of the test may be sent to and displayed on the central system. A system such as this may provide a more convenient and efficient system for larger scale use. In yet further embodiments the test facility associated with one or more smoke detectors may be automatically activated at periodic or pre-programmed intervals. This may allow for more reliable testing of the one or more smoke detectors.

In an alternative arrangement, the test facility may be provided with a separate light source, for example a light emitting diode (LED) arranged so that, when the test facility is activated, light from the light source is incident on the light sensor. This is less preferred as it does not involve testing the light source of the optical sensing system.

Another embodiment of the invention concerns a heat detector. Heat detectors are commonly used and widely understood in the field of fire detection and warning. Heat detectors are based on a temperature sensor and activation of an alarm based on a heat detector may be based on the temperature exceeding a certain value or else the rate of temperature rise exceeding a certain value. The temperature sensor and its associated electronics are considered herein to be the detection components of the heat detector and are referred to as a temperature sensing system.

The test facility is operable to test at least the operability of the temperature sensing system. This may be advantageous as it may provide a convenient way of safely simulating a fire and so testing the temperature sensing system, without having to employ a heat source externally of the detector to create an increased temperature for detection by the temperature sensor.

Preferably the test facility will indicate a fail condition if the heat detector is not operating due to failure of the temperature sensor and/or any associated alarm system and/or failure of power to either. This may be advantageous over standard heat detector test facilities, which return a fail condition only in response to failure of any associated alarm system or power to it.

Preferably the test facility comprises a heat source provided in close proximity to the temperature sensor, wherein the heat source may be activated or deactivated. In this way the effect of heat from a fire can be simulated, and an alarm associated with the temperature sensor should sound if the temperature sensor and alarm are working properly and are supplied with power. If however the alarm does not sound this would be indicative of a failure of either the temperature sensor, the alarm and/or power to either.

Preferably the heat source is provided in the form of a heating coil around the temperature sensor. In this way heating of the coil may rapidly result in activation of any associated alarm, and the tester's time is not unnecessarily wasted.

In some embodiments the test facility is manually actuated via an actuator provided on or in the heat detector. This may provide a relatively cheap and convenient system for small scale use. Alternatively however the test facility may be activated from a remote location. This may particularly be the case where several detectors are connected to a central detection and/or control system. In this case results of the test may be sent to and displayed on the central system. A system such as this may provide a more convenient and efficient system for larger scale use. In yet further embodiments the test facility associated with one or more heat detectors may be automatically activated at periodic or pre-programmed intervals. This may allow for more reliable testing of the one or more heat detectors.

According to a second aspect of the invention there is provided a detector such as a smoke or heat detector for use in detecting fires, the detector being provided with a removable protective cap and means for removing the cap.

The protective cap may act to shield the detector during storage, packaging and transportation prior to installation and during installation itself. The cap removal means may be a convenient way of removing the protective cap when it is no longer required, especially where the detector has been installed in a location where it is difficult to access (e.g. on a high ceiling, in a narrow conduit or in a contaminated area). The cap removal means may be activated when the detector is commissioned or is otherwise ready for use.

The cap removal means may be activated remotely, for example by means of a wireless signal allowing protective caps fitted to a plurality of detectors to be removed at the same time. This is likely to be more convenient than attending to each detector individually and manually removing its protective cap.

Preferably the cap removal means comprises an actuator that physically releases the protective cap. For example, the actuator may comprise a linear actuator such as a push rod that is extended when activated to dislodge the protective cap from the detector. Other means of releasably securing the protective cap so that it can be removed when required may be employed.

Detectors according to the first aspect of the invention may be provided with a protective cap and cap removal means according to the second aspect of the invention.

According to a third aspect of the invention there is provided a detector such as a smoke or heat detector, the detector comprising means for monitoring a parameter or condition and means for testing the monitoring means.

The test means may simulate the parameter or condition to be monitored.

In a smoke detector, the monitoring means may be responsive to light that has been scattered by the presence of smoke such as from a fire in a normal mode of operation and may be responsive to light under the control of the test means in the absence of smoke in a test mode of operation.

The monitoring means may comprise a light sensor, for example a photoelectric sensor, and a light source, for example a light emitting diode (LED) arranged so that light from the light source is not incident on the sensor in the absence of smoke and, when smoke is present, the light is scattered so that at least some of the light is incident on the light sensor.

The monitoring means may trigger an alarm to generate a warning when smoke has been detected. The warning may be in the form of a visual and/or audible alarm such as a flashing light or a buzzer. The warning may be continuous or intermittent. The alarm may be re-settable following activation.

The test means may have an inactive state in the normal mode of operation and an active state in the test mode of operation. In the active state, at least some of the light from the light source may be directed under the control of the test means to be incident on the light sensor. In this way, the test means simulates the presence of smoke in the test mode of operation. The test means may be switched between the active and inactive states for testing the monitoring means.

In a heat detector, the monitoring means may be responsive to an increase in temperature caused by an external heat source such as from a fire in a normal mode of operation and may be responsive to heat under the control of the test means in the absence of an external heat source to cause an increase in temperature in a test mode of operation.

The monitoring means may comprise a temperature sensor such as a thermistor.

The monitoring means may trigger an alarm to generate a warning when a temperature increase has been detected. The warning may be in the form of a visual and/or audible alarm such as a flashing light or a buzzer. The warning may be continuous or intermittent. The alarm may be re-settable following activation.

The test means may have an inactive state in the normal mode of operation and an active state in the test mode of operation. In the active state, the temperature sensor is responsive to a local heat source such as a heating coil. In this way, the test means simulates the presence of an external heat source in the test mode of operation. The test means may be switched between the active and inactive states for testing the monitoring means.

In preferred embodiments, the detector may include a removable protective cap that can be fitted during manufacture to protect components of the detector prior to installation. On or after installation the cap can be removed manually. Alternatively or additionally, the detector may include means operable to dislodge the cap when actuated.

According to a fourth aspect of the invention, there is provided a detector such as a smoke or heat detector for use in detecting fires, the detector being provided with a protective cap which in a first position prevents smoke entering the detector and in a second position allows smoke to enter the detector.

Detectors according to the first aspect of the invention may be provided with a protective cap according to the fourth aspect of the invention.

According to a fifth aspect of the invention, there is provided a light, for example an emergency light, comprising a light source and a chargeable power source such as battery wherein the power source is connected to a fire alarm circuit for charging the power source.

BRIEF DESCRIPTION OF THE DRAWINGS

Embodiments of the various aspects of the invention will now be described in more detail by way of example only with reference to the accompanying drawings in which.

DETAILED DESCRIPTION

Figure 1:
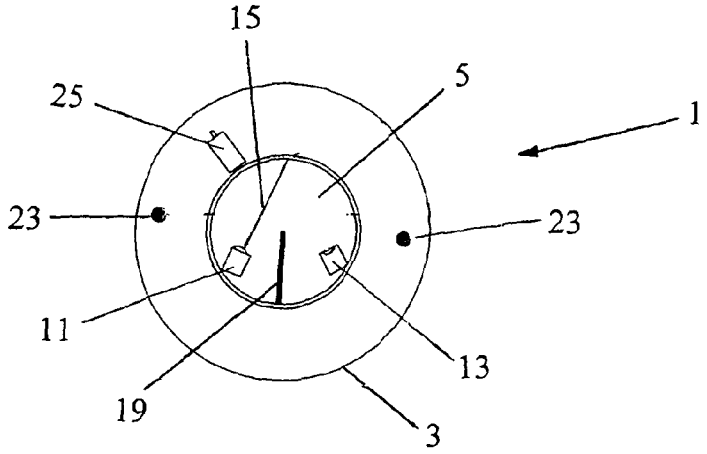
FIG. 1 is a top view of a smoke detector according to a first embodiment of the invention in a normal mode of operation.
Figure 2:
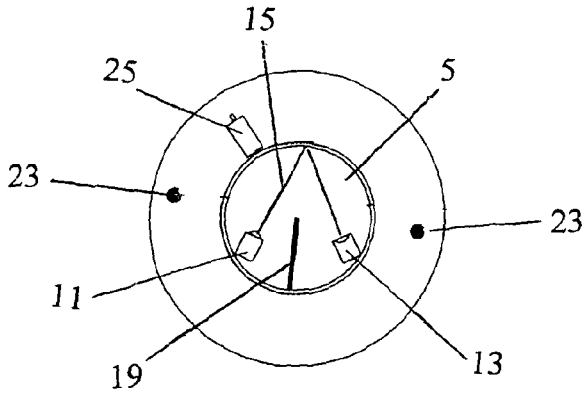
FIG. 2 is a top view of the smoke detector of FIG. 1 in a test mode of operation.
Figure 3:
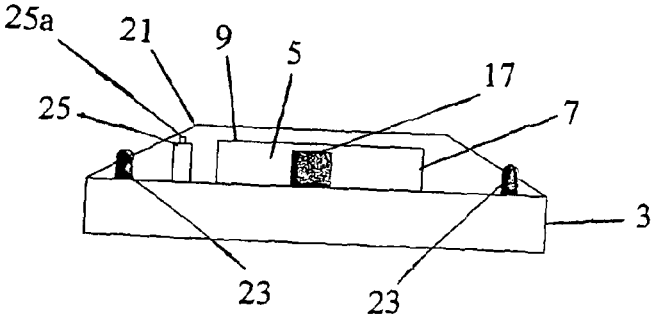
FIG. 3 is a side view of the smoke detector of FIGS. 1 and 2.

Referring first to FIGS. 1 to 3 of the drawings, a smoke detector according to a first embodiment of the invention is generally provided at 1. The smoke detector 1 comprises an annular base 3 which can be secured to a wall or ceiling by any suitable means. Located centrally on the upper surface of the base 3 is a chamber 5 having a cylindrical side wall 7 and an end wall 9. The side wall 7 and/or end wall 9 may be provided with one or more slits so that smoke can enter the chamber 5.

Inside the chamber 5 is a light source 11 and a light sensor 13 positioned around the interior of the sidewall 7. The light source 11 may provide a collimated light beam 15, for example the light source 11 may be a light emitting diode. The light sensor 13 may be a photoelectric sensor. The light source 11 and light sensor 13 are focused on a liquid crystal display (LCD) panel 17. Any suitable light source and light sensor may be employed.

The LCD panel 17 is positioned at a point on the interior wall of the chamber 5 equidistant between and furthest from the light source 11 and the light sensor 13. The LCD panel 17 can be switched between a non-reflecting condition (FIG. 1) in which the light beam 15 is absorbed or transmitted by the LCD panel 17 so as not to be received by the light sensor 13 and a reflecting condition (FIG. 2) in which the light beam 15 from the light source 11 is reflected to be received by the light sensor 13.

A barrier 19 is positioned between the light source 11 and the light sensor 13 and extends from the interior wall towards the centre of the chamber 5 to prevent the light beam 15 from the light source 11 passing directly to the light sensor 13 in both conditions of the LCD panel 17.

The base portion 3 is further provided with a removable protective cap 21 and a pair of warning lights such as LEDs 23. The cap 21 is a push-fit on the base 3 to cover the chamber 5 with the warning LEDs 23 received in apertures in the cap 21. The cap 21 protects the components of the smoke detector 1 during storage, transportation and installation. When fitted, the cap 17 prevents or inhibits smoke from entering the chamber 5.

Once installed, the protective cap 21 can be removed so that the smoke detector is not left with the protective cap 21 in place preventing smoke from a fire reaching the chamber 5. The cap 21 can be removed manually. Alternatively or additionally, an actuator 25 mounted on the base 3 may be provided that is operable when activated to dislodge the protective cap 21. For example, the actuator 25 may comprise a linear actuator having a push rod 25*a* that extends when the actuator is activated to push the protective cap 21 away from the base 3. The actuator 25 can be operated remotely, for example from a controller (not shown) by means of a suitable wireless signal, for example an Rf (radio frequency) signal.

The controller may be provided at a control station or it may be provided in a hand held device that can used to remove the protective cap 21 after installation, for example during final commissioning of a building in which the smoke detector 1 is fitted. This may be particularly beneficial where the smoke detector 1 is installed in a position that is not readily accessible to remove the protective cap 21 manually.

In a normal mode of operation of the smoke detector 1, the LCD panel 17 is in the non-reflecting condition and the light source 11 periodically emits a beam of light 15 towards the LCD panel 17, for example every second or some other pre-determined time interval. In the absence of smoke in the chamber 5, the light beam 15 is not reflected and is not detected by the light sensor 13. When smoke is present in the chamber 5, some of the light from the light beam 15 is scattered by the smoke and is received by the light sensor 13 which generates a signal to trigger an alarm. The alarm may be visual and/or audible, and may be built-into the smoke detector 1, for example the LEDs 23 may flash when the alarm is triggered, and/or located remotely from the smoke detector 1, for example at the control station and/or at the hand held device where provided.

Where the light sensor is a photoelectric sensor, light incident on the sensor causes a current to flow, which in turn may cause the triggering of an alarm. The current produced when the photoelectric sensor is activated may be amplified and fed to an analogue to digital converter, the output of which is used by a processing unit to give the smoke concentration. The alarm may be triggered when a pre-determined smoke concentration is exceeded. The light source and light sensor as well as their associated electronics provide monitoring means for smoke detection.

The smoke detector 1 includes a test facility that allows components of the smoke detector 1 to be tested. When testing the smoke detector 1 in a test mode of operation, the test facility is activated by switching the LCD panel 17 from the non-reflecting condition to the reflecting condition. This can be done remotely for example from a controller (not shown) by means of a suitable wireless signal, for example an Rf signal, different to the signal used to operate the cap actuator. The controller may be provided at a control station or it may be provided in a hand held device. The control station and/or hand held device may comprise controllers for both the cap actuator and the LCD. It will be understood however that in other embodiments the test facility might be activated locally to the smoke detector, perhaps by pressing a button on or in the detector.

When the LCD panel 17 is in the reflecting condition, a light beam 15 emitted by the light source 11 is reflected and is incident on the light sensor 13 generating the signal to trigger the alarm. The test facility is deactivated following testing by switching the LCD panel 17 back to the non-reflecting condition so that light beam 15 from the light source 11 is no longer reflected and incident on the light sensor 13. As a result, the signal is no longer generated and the alarm ceases. It will be appreciated that the alarm will only be activated if the light source, photoelectric sensor and alarm are all functioning correctly and if each is receiving the required power.

Referring now to FIGS. 3 to 6 of the drawings, a smoke detector according to a second embodiment of the invention is generally provided at 101. Similar components to those shown in FIGS. 1 to 3 are correspondingly numbered in the series 100 and the construction and operation of such components will be understood from the description already provided.

In this embodiment, the LCD panel 17 is replaced by a rotor 127 having a cylindrical surface 129 which is reflective on one side 129*a* and non-reflective on the other side 129*b*. In other respects, the construction of the smoke detector 101 is similar to the first embodiment.

Figure 4:
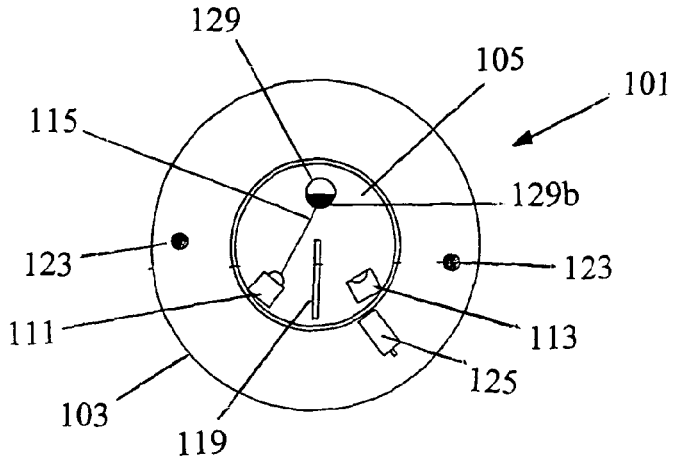
FIG. 4 is a top view of a smoke detector according to a second embodiment of the invention in a normal mode of operation.

In the normal mode of operation of the smoke detector 101 shown in FIG. 4, the non-reflective side 129*b* of the rotor 127 faces the light source 111 so that a light beam 115 emitted by the light source 111 is absorbed and does not reach the light sensor 113 when there is no smoke in the chamber 105. If smoke is present in the chamber 105, the light beam 115 is scattered and some of the scattered light is incident on the light sensor 113 to trigger an alarm.

Figure 5:
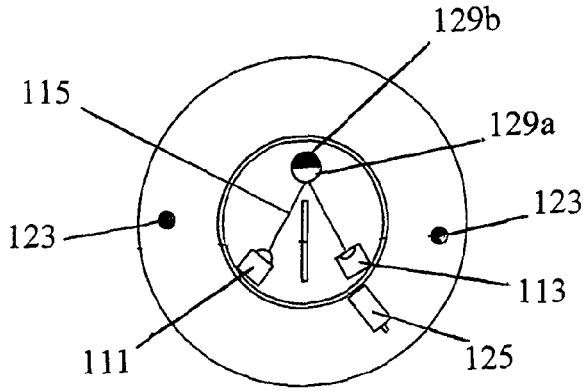
FIG. 5 is a top view of the smoke detector of FIG. 4 in a test mode of operation.
Figure 6:
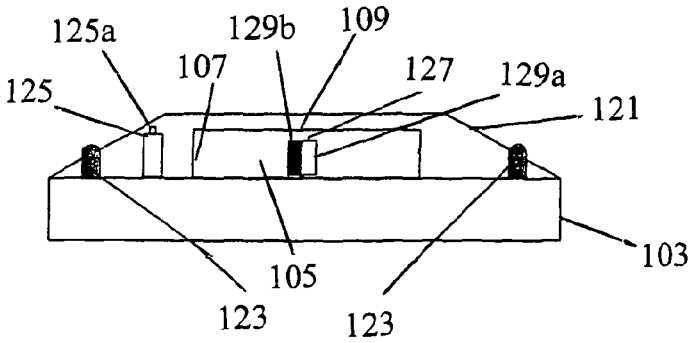
FIG. 6 is a side view of the smoke detector of FIGS. 4 and 5.

In the test mode of operation of the smoke detector 101 shown in FIG. 5, the rotor 127 is rotated so that the reflective side 129*a* faces the light source 111 so that a light beam 115 emitted by the light source 111 is reflected and is incident on the light sensor 113 to trigger an alarm when there is no smoke in the chamber 105.

The rotor 127 can be rotated between the non-reflecting and reflecting conditions remotely, for example by a motor actuated from a controller (not shown) by means of a suitable wireless signal, for example an Rf signal, different to the signal used to operate the cap actuator. The controller may be provided at a control station or it may be provided in a hand held device. The control station and/or hand held device may comprise controllers for both the rotor 127 and the cap actuator 125. It will be understood however that in other embodiments the test facility might be activated locally to the smoke detector, perhaps by pressing a button on or in the detector. In such embodiments, the rotor 127 may be rotated by actuating a motor or it may be manually rotatable.

Figure 7:
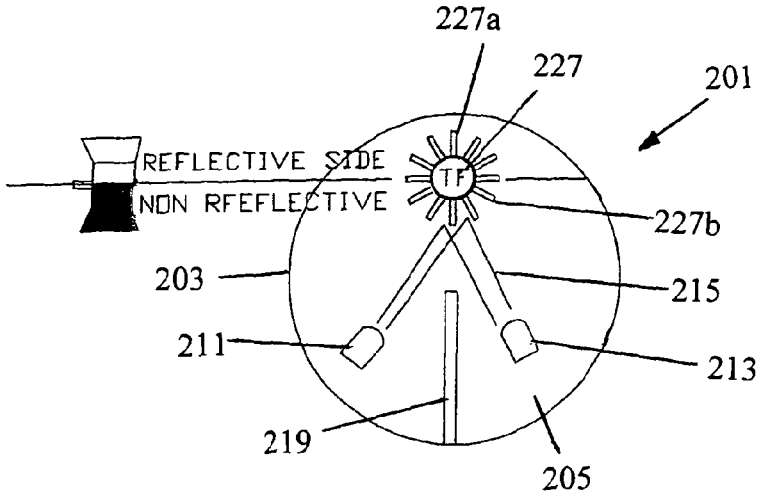
FIG. 7 is a top view of a smoke detector according to a third embodiment of the invention.

Referring now to FIG. 7 of the drawings, a smoke detector according to a third embodiment of the invention is generally provided at 201. Similar components to those shown in FIGS. 1 to 6 are correspondingly numbered in the series 200 and the construction and operation of such components will be understood from the description already provided.

In this embodiment, the LCD panel 17 of the first embodiment and the rotor 127 of the second embodiment are replaced by a fan 227 having a first set of blades 227*a* on one half which are reflecting and a second set of blades 227*b* on the other half that are non-reflecting. The number and/or shape of the blades in each set may be varied from the illustrated arrangement. The light source 211 is an infra-red transmitter and the light sensor 213 is an infra-red detector. Any other suitable light source and light sensor may be employed. In other respects, the construction of the smoke detector 201 is similar to the first and second embodiments.

In normal operation, the fan 227 is stationary with the second set of non-reflecting blades 227*b* arranged so that an infra-red beam 215 from infra-red transmitter 211 is not reflected to be detected by infra-red receiver 213. If smoke is present in the detector chamber 205, the infra-red beam 215 is scattered and some of the light is incident on the infra-red receiver 213 to trigger an alarm.

In the test mode of operation, the fan 227 is rotated so that, when the infra-red beam 215 is incident on the first set of reflecting blades 227*a*, it is reflected and is incident on the infra-red receiver 213 to trigger the alarm when there is no smoke present in the detector chamber 205. A barrier 219 between the infra-red transmitter 211 and the infra-red receiver 213 prevents the infra-red beam 215 passing directly from the transmitter 211 to the receiver 213 both during normal operation and in the test mode of operation. The fan 227 may rotate continuously or intermittently in the test mode of operation. Rotation of the fan 227 in the test mode of operation also serves to blow any dust out of the detector chamber 205 and clean it. The fan 227 may be rotated in a cleaning mode of operation with the sensor means de-activated to prevent an alarm signal being generated. In other respects, the operation of the detector 201 is generally similar to the first and second embodiments.

Figure 8:
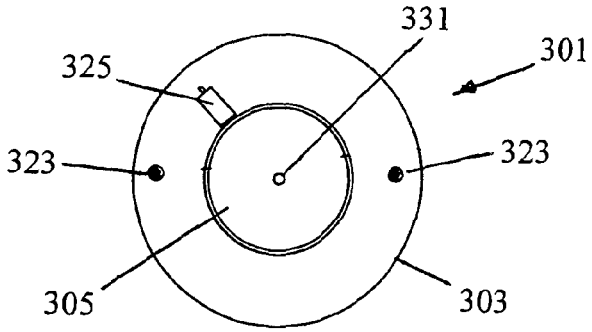
FIG. 8 is a top view of a heat detector according to a fourth embodiment of the invention.
Figure 9:
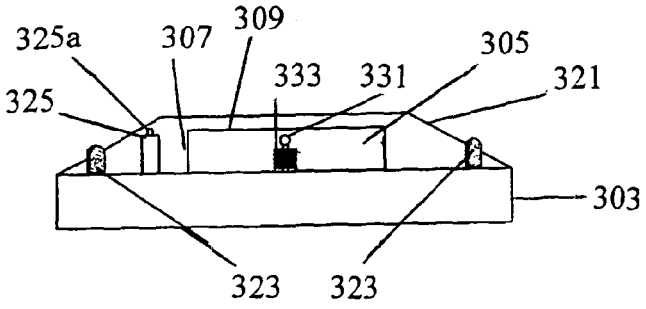
FIG. 9 is a side view of the heat detector of FIG. 8.

Referring now to FIGS. 8 and 9 of the drawings, a heat detector according to a fourth embodiment of the invention is generally provided at 301. Similar components to those shown in FIGS. 1 to 7 are correspondingly numbered in the series 300 and the construction and operation of such components will be understood from the description already provided.

In this embodiment, the light source and light sensor of previous embodiments are replaced by a temperature sensor 331 and the test means is replaced by a heat source 333.

The temperature sensor 331 is preferably positioned at the centre of the chamber 305 and may comprise a thermistor of which the resistance varies with temperature. Consequently as temperature changes occur (for example in the event of a fire) current flowing in a circuit incorporating the thermistor varies. This change in current may be indicative of a fire and may be used to activate an alarm. The current variation is linear over a temperature range of approximately 25° C. to 90° C. The current may therefore be fed to an analogue to digital converter and the output used by a processing unit to give the temperature. Activation of the alarm may be based on the temperature exceeding a certain value or else the rate of temperature rise exceeding a certain value. The temperature sensor 331 and its associated electronics provide monitoring means for temperature detection.

The heat source 333 may be a heating coil that extends around the temperature sensor 331 in close proximity thereto while allowing air in the chamber 305 to circulate over the temperature sensor 331.

In use, the protective cap 321 can be removed after installation of the heat detector 301 either manually or by means of the cap actuator 325 and the sidewall 307 and/or end wall 309 of the chamber 305 are provided with openings (not shown) such as slits so that air from the surroundings can enter the chamber 305 due to convection.

In this way the temperature sensor 331 can monitor changes in the temperature of the surrounding air and generate a signal to trigger an alarm when the air temperature or the rate of temperature increase exceeds a pre-determined value that may indicate there is a fire in the vicinity of the heat detector 301. It will be understood, however that the heat detector may be used to monitor an abnormal increase in air temperature from other causes such as overheating of electrical equipment, for example in a computer server room.

The heat detector 301 includes a test facility that allows components of the detector 301 to be tested. The test facility is activated when it is desired to test the heat detector 301 by switching on the heat source 333. This can be done remotely for example from a controller (not shown) by means of a suitable wireless signal, for example an Rf signal, different to the signal used to operate the cap actuator. The controller may be provided at a control station or it may be provided in a hand held device. The control station and/or hand held device may comprise controllers for both the heating coil 333 and cap actuator 325. It will be understood however that in other embodiments the test facility might be activated locally to the smoke detector, perhaps by pressing a button on or in the detector.

When the heat source 333 is switched on, the air in the chamber 305 is heated to a temperature beyond the pre-determined value, and/or at a rate beyond the pre-determined value causing the temperature sensor 331 to generate the signal to trigger the alarm. The test facility is deactivated following testing by switching the heat source 333 off. As a result, the signal is no longer generated and the alarm ceases. It will be appreciated that the alarm will only be activated if the temperature sensor and alarm are all functioning correctly and if each is receiving the required power.

A power source for the above-described detectors 1,101, 201,301 may be provided by one or more batteries. Means may be provided for monitoring the power level of the or each battery and generating a warning when a battery needs to be replaced. The warning may be visual and/or audible and may be provided locally to the detector or remotely therefrom, for example at a control station. Alternatively, the detectors 1,101,201,301 may be wired to a power supply and one or more batteries may be provided as a back-up to enable the detector to continue working if the power supply is interrupted.

For some applications, a single detector 1,101,201,301 may be sufficient. In such applications, the test facility may be manually activated via an actuator provided on or in the heat detector. This may provide a relatively cheap and convenient system for small scale use. Alternatively however the test facility may be activated from a remote location. This may particularly beneficial for applications where several detectors are employed. In such applications, the detectors may be connected to a central detection and/or control system by wired or wireless links. The detectors may be linked to form a network. The results of tests may be sent to and displayed on the central system. Individual detectors may be identifiable so that results of tests can be logged and the location of any detector that has generated a test failure signal can be readily determined for repair or maintenance work to be carried out. Also, the location of any detector generating an alarm signal can be readily determined to identify the location of a possible fire. A system such as this may provide a more convenient and efficient system for larger scale use. In yet further embodiments the test facility associated with one or more detectors may be automatically activated at periodic or pre-programmed intervals. This may allow for more reliable testing of detectors.

Figure 10:
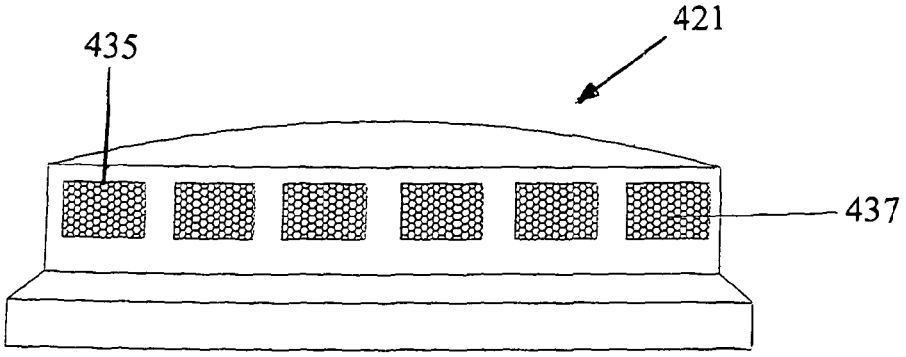
FIG. 10 is a side view of an alternative protective cap according to the invention.
Figure 11:
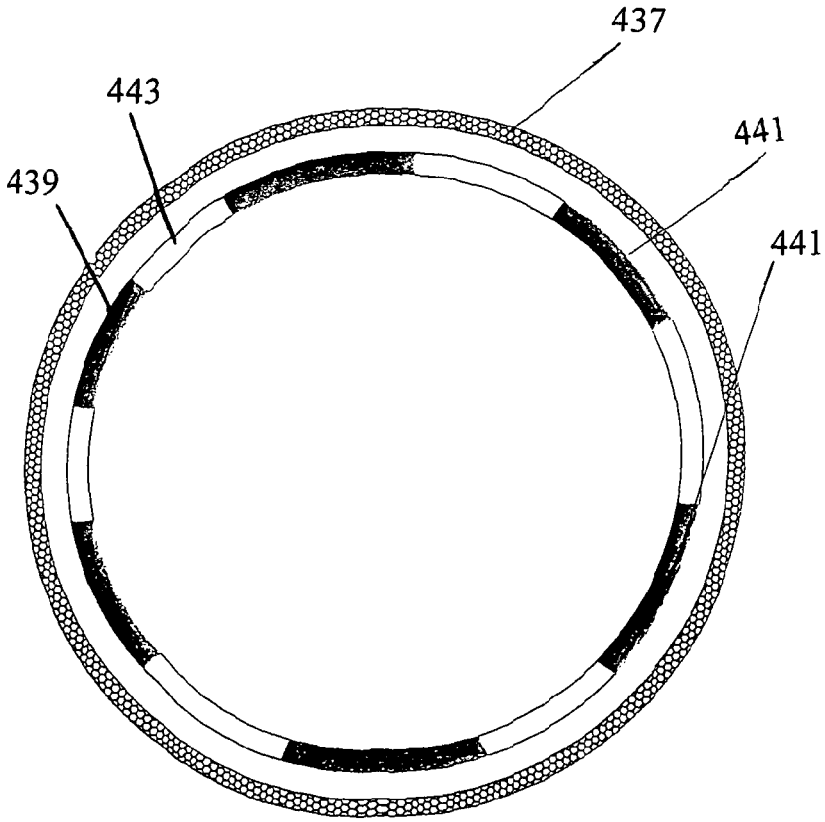
FIG. 11 is a plan view of the protective cap of FIG. 10.

Referring now to FIGS. 10 and 11, there is shown an alternative protective cap 421 that can be used in place of the removable protective cap of the previous embodiments.

The protective cap 421 is intended to remain in place on the detector and has a series of circumferentially spaced openings 435 in an outer part covered by micro-mesh 437 to prevent insects entering the detector while allowing smoke from a fire to enter the detector. An internal element 439 is rotatable between a first position in which parts 441 of the element 439 block the openings 435 and a second position in which openings 443 in the element 439 are aligned with the openings 435. During storage, transportation and installation, the element 439 is in the first position to protect the internal components of the detector from contamination by dust or the like that may otherwise enter the detector during construction work prior to commissioning. On completion of construction work, the element 439 can be rotated to the second position to enable the detector to operate by allowing smoke from a fire to pass through the openings 435 in the outer part of the cap 421 into the detector chamber for detection to trigger an alarm by any of the arrangements disclosed in FIGS. 1 to 9. The element 439 may be rotated manually, for example by suitable means (not shown) on the cap 421 either with the cap 421 in position or by removing the cap 421 and re-fitting the cap 421 after the element 439 has been rotated. Alternatively, the element 439 may be rotated remotely from a control panel or hand held device that transmits a signal, for example a wireless signal such as a radio frequency signal, to operate a motor (not shown) within the detector to rotate the element 439. In a modification (not shown), the element 439 may be located on the outside of the cap 421 to surround the openings 435 in the cap 421. In this modification, the element 439 may be rotated manually or remotely to operate a motor (not shown) to rotate the element 439. In another modification (not shown), the cap 421 may be rotatable relative to the element 439 so that the openings 435 and 443 are misaligned in the first position and aligned in the second position. In this modification, the cap 421 may be rotated manually or remotely to operate a motor (not shown) to rotate the cap 421. In another modification (not shown), the cap 421 may be fitted in either the first or second position and can be removed in one position and re-fitted in the other position. In any of the above arrangements, means may be provided to give a visual indication of the relative position of the cap 421 and element 435 for confirming if the openings 435 and 443 are aligned or misaligned. This may be useful when the detector is located in a relatively inaccessible position.

Figure 12:
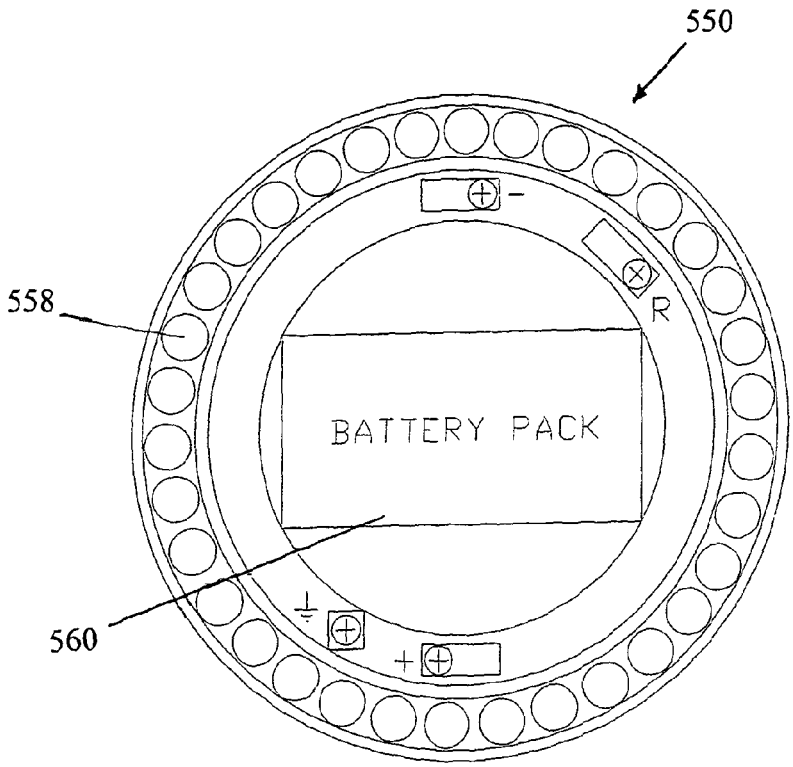
FIG. 12 is a plan view of a light according to a fifth embodiment of the invention.
Figure 13:
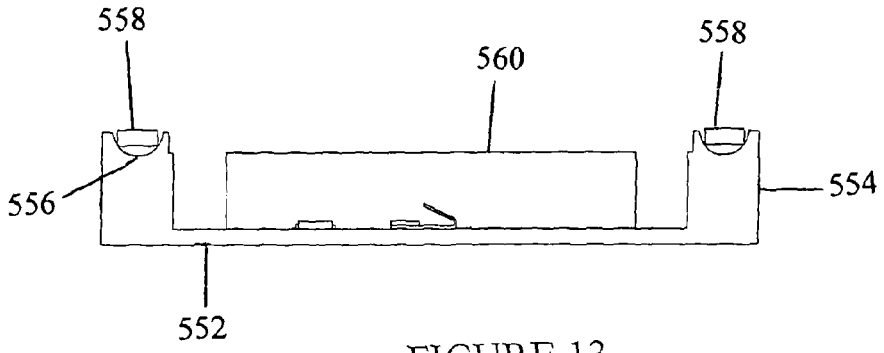
FIG. 13 is a side view of the light of FIG. 12.

Referring now to FIGS. 12 and 13, there is shown a light 550 that can be switched on in the event of mains failure preventing operation of the normal lighting system. The light 550 comprises a circular base 552 from which a wall 554 extends on one side around the peripheral edge of the base 552. The wall 554 has a channel 556 in the outer end face in which a light source such as a plurality of light emitting diodes 558 is arranged. The light source is powered by a battery pack 560 which may be trickle charged from the fire alarm loop and has an operating life of six hours which should normally be sufficient to provide illumination for people to escape from a building in which the light is positioned and/or for rescuers entering the building to locate people who may be injured or trapped. The operating life may be more or less than six hours. The light 550 may be switched on automatically or manually if mains power supply to the normal lighting circuit fails either by a switch (not shown) on the light 550 or remotely from a control panel or hand held device that transmits a signal, for example a wireless signal such as a radio frequency signal, to operate the light 550. It will be understood that a plurality of lights 550 may be provided to illuminate areas within a building leading to exits, for example corridors. The light may be provided with a cover (not shown) that may be light transmitting and remain in place during storage, transportation, installation of the light and in use of the light. Alternatively, the cover may be removable and may protect the light for storage, transportation and installation and then be removed in similar manner to the protective caps described herein.

It will be understood that the invention is not limited to the embodiments above-described and various modifications and improvements can be made without departing from the various concepts described herein. Features of any of the embodiments may be employed separately or in combination with features of any other embodiments and the invention extends to and includes all combinations and sub-combinations of one or more features described herein in any form of detector.

Moreover, while the invention has been described with particular reference to smoke and heat detectors that can be used to detect a fire, it will be understood that the invention has wider application to any detector for monitoring and detecting a change in a parameter or condition for any purpose.

What is claimed is:

1. A detector comprising sensor means for detecting smoke or heat and generating a warning when activated in a normal mode of operation, and test means operable to activate the sensor means in the absence of smoke or heat in order to test the detector in a test mode of operation, wherein a protective cap is provided for a chamber containing the sensor means and test means, and wherein the cap prevents smoke entering the chamber and is removable to allow smoke to enter the chamber in use of the detector.

2. The detector according to claim 1 comprising an optical smoke detector wherein the sensor means is a light sensor arranged to detect light from a light source that has been scattered by smoke from a fire in the normal mode of operation, and wherein the test means is operable to reflect light from the light source onto the light sensor in the test mode of operation.

3. The detector according to claim 2 wherein, the test means provides a reflective surface in the test mode of operation so that the light sensor receives light from the light source that has been reflected by the reflective surface.

4. The detector according to claim 3 wherein, the test means is rotatable to present a non-reflecting surface to the light source in the normal mode of operation and to present the reflecting surface to the light source in the test mode of operation.

5. The detector according to claim 4 wherein the non-reflecting and reflecting surfaces are provided on a rotor member that presents the non-reflecting surface to the light source in the normal mode of operation and can be rotated to present the reflecting surface to the light source in the test mode of operation.

6. The detector according to claim 5 wherein the rotor member can be rotated continuously or intermittently in the test mode of operation so that the reflecting surface is presented to the light source for at least part of the test mode of operation.

7. The detector according to claim 5 wherein the rotor member comprises a fan and the non-reflecting and reflecting surfaces are provided on blades of the fan.

8. The detector according to claim 7 wherein the fan is rotatable during the test mode of operation.

9. The detector according to claim 7 wherein the fan is stationery during the normal mode of operation.

10. The detector according to claim 1 wherein an actuator is provided to remove the cap.

11. A detector having sensor means for detecting smoke and generating a warning when activated in a normal mode of operation, and test means operable to activate the sensor means in the absence of smoke in order to test the detector in a test mode of operation, wherein a protective cap is provided for a chamber containing the sensor means and test means, wherein the cap prevents smoke entering the chamber in a first position and is adjustable to allow smoke to enter the chamber in use of the detector.

12. A heat detector having sensor means for detecting heat and generating a warning when activated in a normal mode of operation and test means operable to activate the sensor means in the absence of heat in order to test the detector in a test mode of operation, wherein the sensor means comprises a temperature sensor arranged to detect an increase in ambient temperature from a fire in the normal mode of operation and wherein the test means is operable to generate an increase in temperature in the test mode of operation.

13. The detector according to claim 12 wherein the test means comprises a heat source that is activated in the test mode of operation and de-activated in the normal mode of operation.

14. The detector according to claim 13 wherein the heat source comprises a heating coil located around the temperature sensor.

15. An optical smoke detector comprising sensor means for detecting smoke and generating a warning when activated in a normal mode of operation, and test means operable to activate the sensor means in the absence of smoke in order to test the detector in a test mode of operation, the sensor means is a light sensor arranged to detect light from a light source that has been scattered by smoke from a fire in the normal mode of operation, and wherein the test means is operable to reflect light from the light source onto the light sensor in the test mode of operation, wherein non-reflecting and reflecting surfaces are provided on a rotor member that presents the non-reflecting surface to the light source in the normal mode of operation and can be rotated to present the reflecting surface to the light source in the test mode of operation, and wherein the rotor member can be rotated continuously or intermittently in the test mode of operation so that the reflecting surface is presented to the light source for at least part of the test mode of operation.

16. An optical smoke detector comprising sensor means for detecting smoke and generating a warning when activated in a normal mode of operation, and test means operable to activate the sensor means in the absence of smoke in order to test the detector in a test mode of operation, the sensor means is a light sensor arranged to detect light from a light source that has been scattered by smoke from a fire in the normal mode of operation, and wherein the test means is operable to reflect light from the light source onto the light sensor in the test mode of operation, wherein non-reflecting and reflecting surfaces are provided on a rotor member that presents the non-reflecting surface to the light source in the normal mode of operation and the reflecting surface to the light source in the test mode of operation, and wherein the rotor member comprises a fan and the non-reflecting and reflecting surfaces are provided on blades of the fan.

17. The optical smoke detector according to claim 16 wherein the fan is rotatable during the test mode of operation to present the reflecting surface to the light source and is stationary during the normal mode of operation to present the non-reflecting surface to the light source.

18. The optical smoke detector according to claim 16 wherein a protective cap is provided for a chamber containing the sensor means and test means, wherein the cap prevents smoke entering the chamber and can be moved to allow smoke to enter the chamber in use of the detector.

* * * * *